US009080336B1

(12) United States Patent
Yantis

(10) Patent No.: US 9,080,336 B1
(45) Date of Patent: Jul. 14, 2015

(54) OIL WELL WORKOVER EQUIPMENT

(71) Applicant: Joey Yantis, Bakersfield, CA (US)

(72) Inventor: Joey Yantis, Bakersfield, CA (US)

( * ) Notice: Subject to any disclaimer, the term of this patent is extended or adjusted under 35 U.S.C. 154(b) by 0 days.

(21) Appl. No.: 14/544,736

(22) Filed: Feb. 10, 2015

(51) Int. Cl.

| | |
|---|---|
| ***E04G 1/00*** | (2006.01) |
| ***E04G 3/24*** | (2006.01) |
| ***E04G 5/14*** | (2006.01) |
| ***E21B 19/14*** | (2006.01) |

(52) U.S. Cl.
CPC .. *E04G 3/24* (2013.01); *E04G 5/14* (2013.01); *E21B 19/14* (2013.01)

(58) Field of Classification Search
CPC ..... E04G 3/24; E21B 19/14; B66F 11/04
See application file for complete search history.

(56) References Cited

U.S. PATENT DOCUMENTS

| | | | | |
|---|---|---|---|---|
| 1,841,671 | A * | 1/1932 | Rawson | 182/114 |
| 2,257,520 | A * | 9/1941 | York | 182/114 |
| 2,358,755 | A * | 9/1944 | Woody et al. | 182/82 |
| 3,976,207 | A * | 8/1976 | Schultz | 414/22.51 |
| 4,068,737 | A * | 1/1978 | Lenz | 182/69.6 |
| 4,163,625 | A * | 8/1979 | Jenkins | 414/22.63 |
| 5,042,612 | A * | 8/1991 | Bennett et al. | 182/1 |
| 5,671,823 | A * | 9/1997 | Oakes | 182/36 |
| 6,681,894 | B1 * | 1/2004 | Fanguy | 182/113 |
| 7,216,741 | B2 * | 5/2007 | MacDonald et al. | 182/113 |
| 8,746,403 | B1 * | 6/2014 | Tyner et al. | 182/127 |
| 2009/0257848 | A1 * | 10/2009 | Stroshein et al. | 414/22.65 |
| 2012/0006619 | A1 * | 1/2012 | DuBose et al. | 182/113 |

* cited by examiner

*Primary Examiner* — Charles A Fox
*Assistant Examiner* — Kristine Florio
(74) *Attorney, Agent, or Firm* — Dennis W. Beech

(57) ABSTRACT

A support assembly has two position rods attachable to two beam members spaced apart and attached vertically on a platform structure. A platform support frame is slidably engaged at opposed spaced apart sides on the two position rods and the platform support frame may be moved vertically by a hydraulic actuator. A work platform is rotatably attached at a floor edge to the platform support frame for the work platform to be rotated between a horizontal position and a vertical position by a hydraulic actuator. A work floor of the work platform has a central portion having an opening therein. A telescoping arm is slidably inserted in a plate that is attached centrally in the platform support frame for extending and retracted the telescoping arm over the work floor by a hydraulic actuator. A hydraulic control unit is connected to each hydraulic actuator.

9 Claims, 6 Drawing Sheets

OIL WELL WORKOVER EQUIPMENT

BACKGROUND OF THE INVENTION

This invention relates to systems and equipment used to workover or repair production oil well in a field environment. The new equipment is a structure with apparatus for positioning over a production oil well site for safe and efficient work and repair of downhole oil well equipment such as a sucker-rod string, well tubing and the like.

For production oil wells in production oil fields there is generally an artificial-lift pumping system using a surface power source to drive a downhole pump assembly. A beam and crank assembly creates reciprocating motion in a sucker-rod string that connects to the downhole pump assembly. The pump may contain a plunger and valve assembly to convert the reciprocating motion to vertical fluid movement. Wells may also be outfitted with a collection of valves and fittings that may be a production tree for extracting production fluids.

Workovers of production wells are often necessary in older wells to replace tubing and to remove material effecting the well production. Depending on the type of lift system and wellhead a lightweight workover unit specifically designed for running and retrieving rod strings and rod pumps may be used for well workovers. These rod units are generally truck-mounted for field use and configured to suit the relatively light work associated with rod-pumping servicing.

Lightweight workover units may currently be known, see FIG. 1, that have a structural support assembly 16, 18 attached or mounted to a flatbed truck or trailer at the rear portion of the truck bed 110. The structure is usually a rectangular tubular beam assembly positioned at the back edge of the truck bed that has support beams attached to be positioned and attach forwardly in the truck bed structure to support the positioning of a work platform structure over a wellhead site. The work platform floor may be slidably engaged by sleeve tubes or sleeved brackets 34 on vertically positioned rods 16 or tubes that are fixedly attached to the support assembly.

Current practice is to manually attach the work platform to the sleeve tubes with the work floor oriented horizontal to the work site ground. The work floor is then positioned vertically on the vertical rods or tubes using available external lifting equipment 116, winches, pulleys or block and tackle, derrick-mast-tower and draw works, or other power lifting apparatus to raise and lower the relatively heavy work platform to each position necessary for a work crew to work on the wellhead equipment as well as to move pumps and other well equipment to be repaired or replaced. At each position the work platform is pinned in place using position pins 36 inserted through holes in the sleeves and rods.

In addition, known workover units have a pneumatic, rotating arm unit 130 attached to a vertical beam 18 of the support assembly. The pneumatic arm, which has been used for many years on oil field workover equipment, is positioned in a retracted, general downward orientation above the inside edge of the attached work floor 32. The arm is for use in moving rods and pipes away from the wellhead when removed and to position rods over a rod string when being attached to the sucker-rod string. The pneumatic arm 130, 132, 138 swinging when activated can be dangerous to workers on the work platform, and the arm is not useful for positioning the work floor.

What is needed is a self-powered support assembly to more safely work with rods, pipes and other oil well equipment during workover; and to position the work floor at various positions and elevations to improve work efficiency.

SUMMARY OF THE INVENTION

The present invention is directed to apparatus for production oil well workover and may include a support assembly that has two position rods attachable to two beam members spaced apart and attached vertically on a platform structure. A platform support frame may be slidably engaged at opposed spaced apart sides on the two position rods and the platform support frame may be moved vertically by a hydraulic actuator. A work platform is rotatably attached at a floor edge to the platform support frame for the work platform to be rotated between a generally horizontal position and a generally vertical position by a hydraulic actuator. A work floor of the work platform has a central portion having an opening therein. A telescoping arm is slidably inserted in a plate that is attached approximately centrally in the platform support frame for the telescoping arm to be extended to and retracted from a position over the work floor by a hydraulic actuator. A hydraulic control unit is connected to each hydraulic actuator.

These and other features, aspects and advantages of the present invention will become better understood with reference to the following drawings, description and claims.

BRIEF DESCRIPTION OF THE DRAWINGS

FIG. 4 A illustrates a perspective top view of a rod support tray according to an embodiment of the invention;

DETAILED DESCRIPTION

Figure 1:
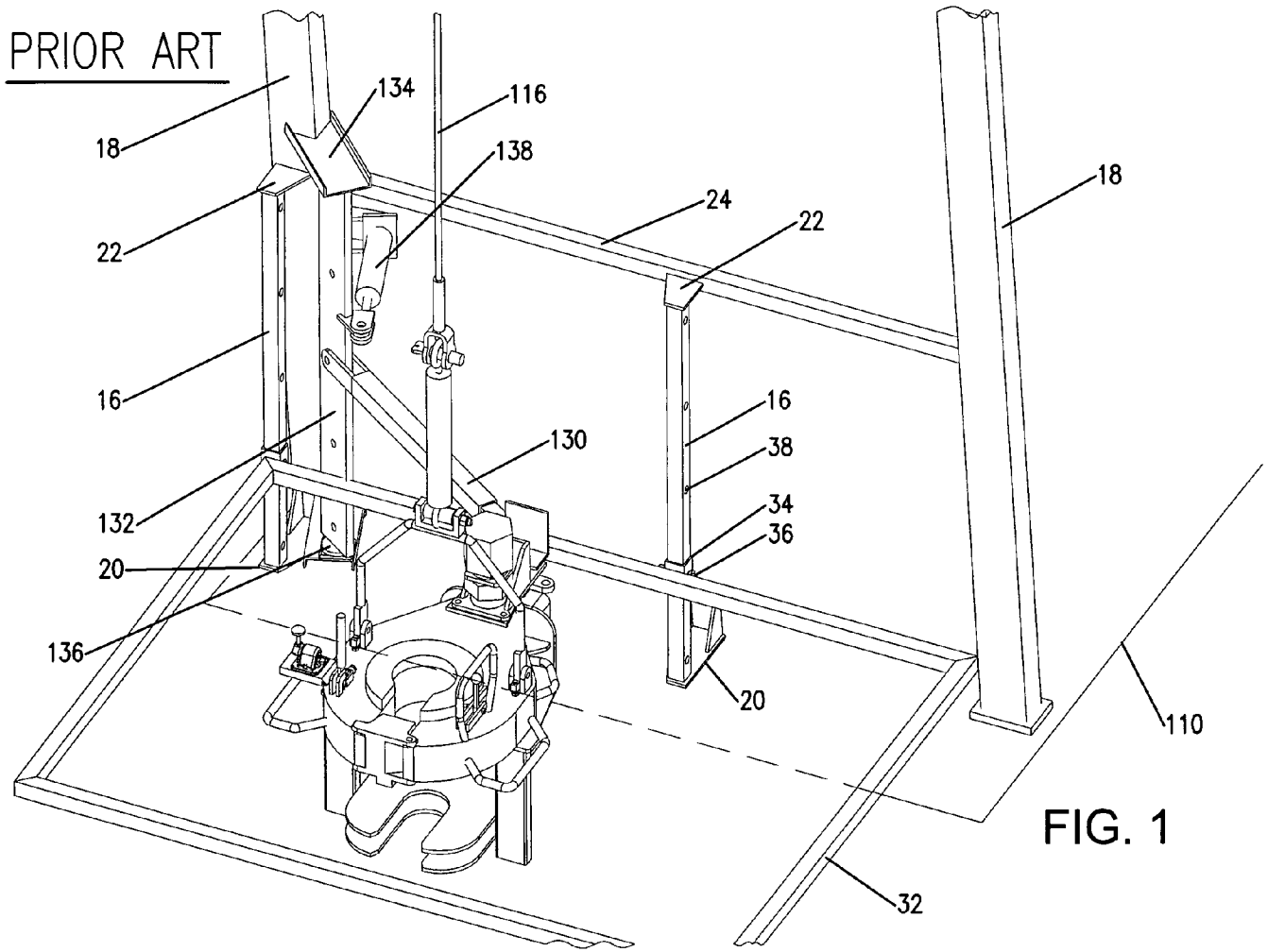
FIG. 1 illustrates a perspective rear view of a currently known workover unit.
Figure 2:
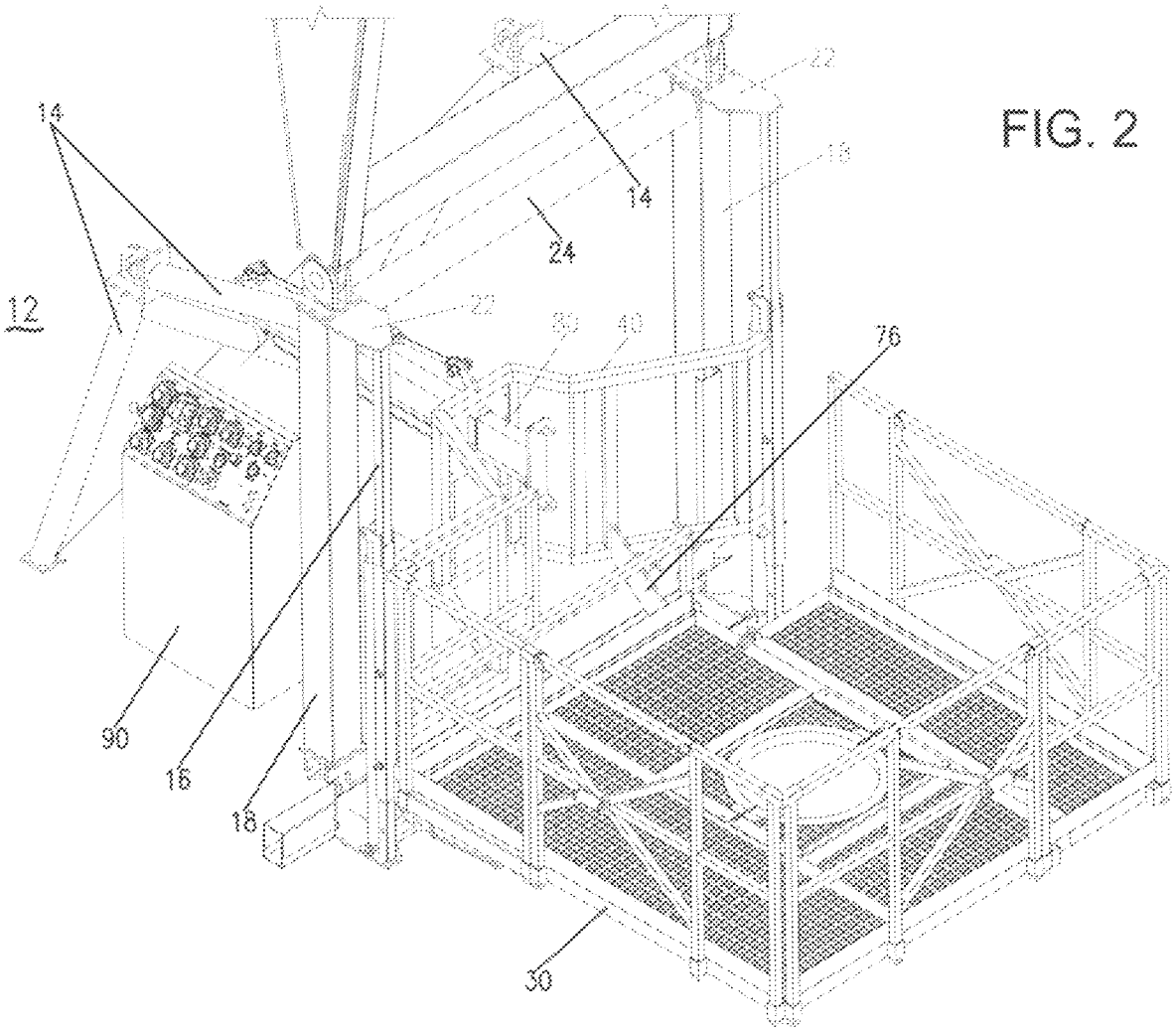
FIG. 2 illustrates a perspective rear view of a workover unit and partial view of a support assembly according to an embodiment of the invention.

The following detailed description represents the best currently contemplated modes for carrying out the invention. The description is not to be taken in a limiting sense, but is made merely for the purpose of illustrating the general principles of the invention.

Referring to FIGS. 2 through 6, an oil well workover unit 10 for positioning on a flatbed truck 110 or other movable platform has a support assembly 12, a work platform 30, a telescoping arm assembly 80, and a hydraulic control unit 90. The support assembly 12 has two vertical beam members 18 attached at a bottom end 20 at the rear end 106 of a movable platform 110, and adjacent a top end 22 a cross beam member 24 is attached at each end to one of each vertical beam members 18. Multiple support beams 14 are attached to the support assembly 12 at the top end 22 to extend forwardly of the support assembly 12 on the flatbed 110 to from a tower base structure.

The two vertical beam members 18 each have a vertical rod 16 or tube attached spaced apart and rearward of the beam members 18. The work platform 30 is rotatably attached to a platform support frame 40 that has a vertical sleeve tube 34 at each side 42 positioned to be slidably engaged with the vertical rods 16. The frame 40 may be raised and lowered by moving the sleeve tubes 34 along the rods 16. There are hydraulic actuators 44 attached at the bottom end 46 of the rods 16 and at the top end 48 of the sleeves 34. The hydraulic actuators 44 can be actuated at a hydraulic control unit 90 to raise and lower the platform support frame 40 and the attached work platform 30. The rods 16 and sleeves 34 may have through holes 38 formed therein for insertion of position pins 36 to aid in retaining the work platform 30 at selected heights above a wellhead site.

The work floor 32 of the work platform 30 may have attachment brackets 52 extending outwardly at an edge 50 to be rotatably engaged with a floor bracket 76 attached to a sleeve tube 34 and to the platform support frame 40. The rotational position of the work floor 32 may be controlled by one or more floor hydraulic actuators 56 attached to floor bracket 76 with actuator bracket 53 and to the work floor 32. This may also allow powered rotating of the work floor 32 to a position adjacent the vertical rods 16 for storage and transport. The work floor 32 may have railings 58 extending upwardly at the peripheral edge 59. These railings may be removable inserted in railing brackets 78.

Figure 3:
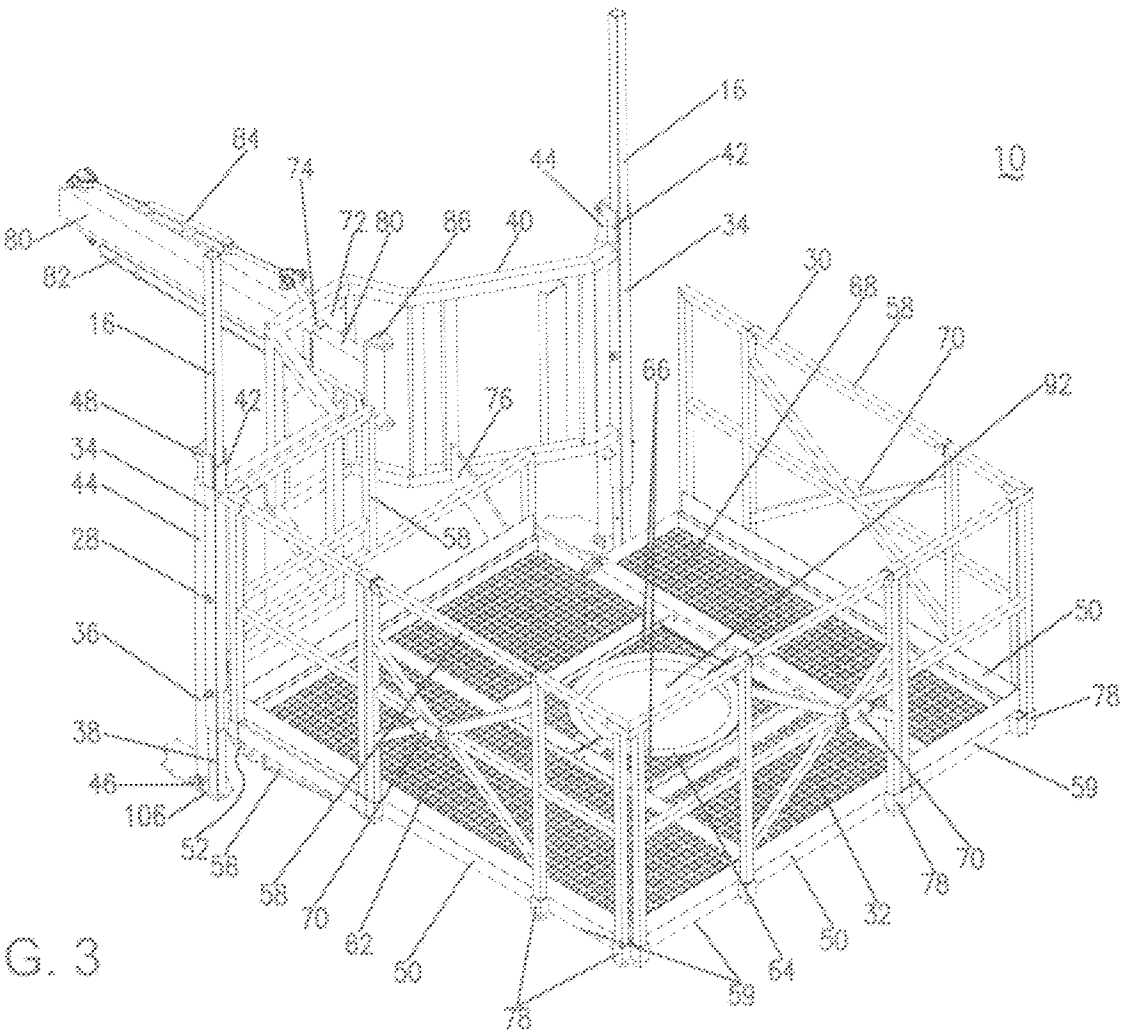
FIG. 3 illustrates a perspective rear view of a workover unit according to an embodiment of the invention.

The work floor 32 may be structured with portions or panels that are releasably attached to a fixed floor 62 portion as best viewed in FIG. 3. A generally central portion 64 of the work floor 32 may be open to provide a relatively large access opening and may have one or more floor panels 66 that may be attached to present a smaller opening for work at the well site. The overall work floor size may also be expanded by attachment of side panels 68. Rollers 70 may be rotatably attached to members of the railings 58 to aid in laying down pipes or rods.

The beam structure of the platform support frame 40 has a plate 72 centrally positioned with a hole 74 therethrough for slidable engagement of a telescoping arm 80. There is a hydraulic actuator 82 to extend and retract the arm 80, and a horizontal support assembly 84 to maintain the arm 80 in a generally horizontal orientation relative to the well site ground surface and the work floor 32. The operative end of the arm 80 may have a bracket 86 or tong connector for use in holding well head equipment on which work is to be performed, to aid in moving and positioning pipe and rods, and for other like workover operations at a well site.

There is a hydraulic control unit 90 with gauges and switch controls that are linked to hydraulic lines that flow fluid to the various hydraulic actuators for the workover unit 10. The reference to beams, rods and tubing may include use of round or rectangular cross-section structures.

Figure 4:
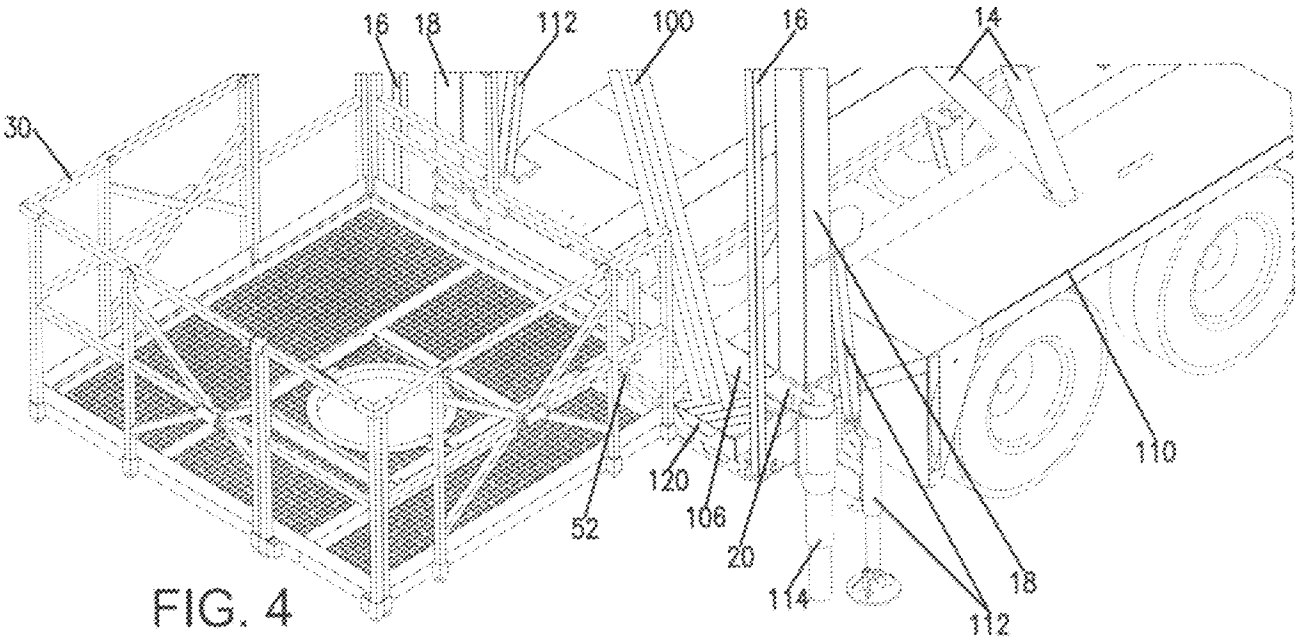
FIG. 4 illustrates a perspective rear view of a workover unit and partial view of a truck bed platform according to an embodiment of the invention.
Figure 4A:
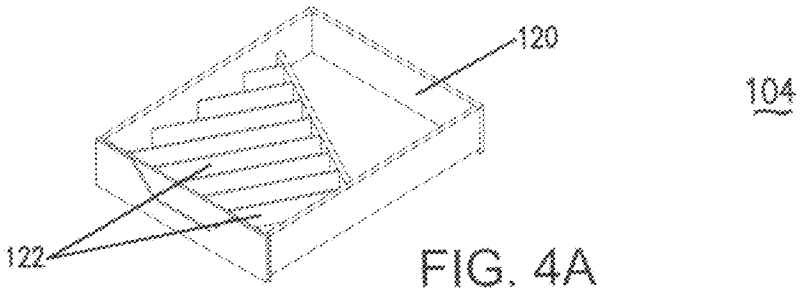
Figure 5:
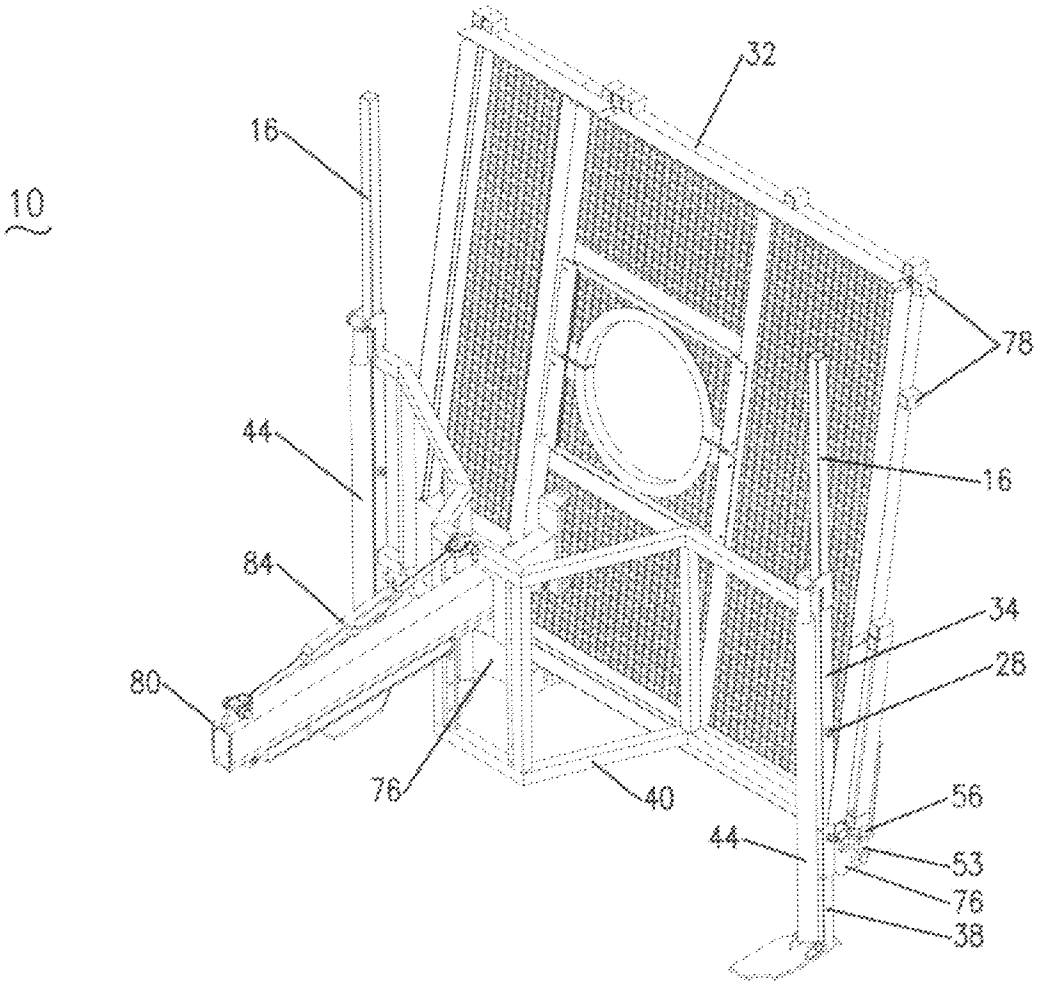
FIG. 5 illustrates a perspective view of a work platform rotated to a vertical position according to an embodiment of the invention.
Figure 6:
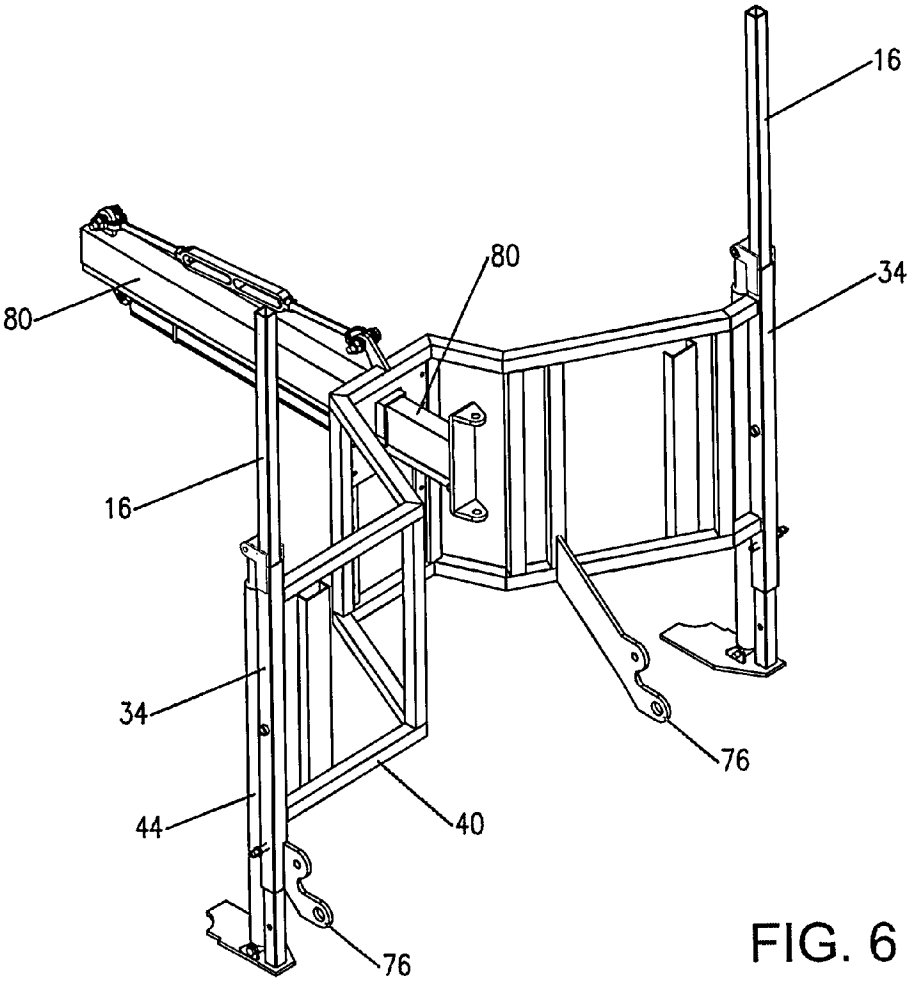
FIG. 6 illustrates a perspective view of a platform support frame and telescoping arm according to an embodiment of the invention.

There may be a slidable tray 120 or drawer with grooves 122 or channels formed in the surface of the tray 120 for use in positioning rods or tubes that are racked at the workover site, as best viewed in FIGS. 4 and 4A. The grooves 122 are formed in the tray 120 to be at an acute angle relative to a centerline along the longitudinal length of the arm 80 and central portion 64 of the work floor 32 to aid in moving the bottom end of rods and tubes between the well and rack storage.

While the invention has been particularly shown and described with respect to the illustrated embodiments thereof, it will be understood by those skilled in the art that the foregoing and other changes in form and details may be made therein without departing from the spirit and scope of the invention.

I claim:

1. An apparatus for oil well workover comprising:

a support assembly that has two position rods attachable to two beam members spaced apart and attached vertically on a platform structure;

a platform support frame slidably engaged at opposed spaced apart sides on said two position rods and said platform support frame is moved vertically by at least one first hydraulic actuator;

a work platform rotatably attached at a floor edge to said platform support frame for said work platform to be rotated between a generally horizontal position and a generally vertical position by at least one second hydraulic actuator;

a work floor of said work platform has a central portion having an opening therein;

a telescoping arm is slidably disposed in a plate having an aperture therein that is attached approximately centrally in said platform support frame for said telescoping arm to be extended to and retracted from a position over said work floor by a third hydraulic actuator; and a hydraulic control unit is connected to said at least one first hydraulic actuator, said at least one second hydraulic actuator, and said third hydraulic actuator.

2. The apparatus as in claim 1 wherein said platform support frame has a sleeve tube slidably attached to said opposed spaced apart sides and disposed on said position rods, and said first hydraulic actuators are attached at a bottom end of each of said position rods and attached at a top end to each of said sleeve tubes.

3. The apparatus as in claim 2 wherein said position rods and said sleeve tubes having a plurality of apertures therein disposed for insertion of position pins.

4. The apparatus as in claim 2 wherein one of said sleeve tubes has a first floor bracket having an aperture therein attached and disposed for rotational attachment to a first attachment bracket of said work platform, and said work platform has a second floor bracket having an aperture therein attached and disposed for rotational attachment to a second attachment bracket of said work platform.

5. The apparatus as in claim 1 wherein said telescoping arm is slidably disposed in a horizontal support assembly and said telescoping arm has a bracket at one end.

6. The apparatus as in claim 1 wherein:

said work floor is generally a rectangular shape with four sides;

a fixed floor portion has a plurality of floor panels attached and disposed relative to said central portion; and a peripheral edge of said work floor has a plurality of railings removably attached and extending vertically above said work floor.

7. The apparatus as in claim 6 wherein a side panel is attached to one of said four sides of said fixed floor portion to expand said work floor size.

8. The apparatus as in claim 6 wherein a plurality of rollers are rotatably attached and disposed on said plurality of railings.

9. The apparatus as in claim 1 wherein a tray is slidably disposed in said platform structure adjacent to said work platform wherein said tray has a plurality of grooves formed therein at an acute angle relative to a centerline along the longitudinal length of said telescoping arm.

* * * * *